US006295037B1

(12) United States Patent
Williams

(10) Patent No.: US 6,295,037 B1
(45) Date of Patent: Sep. 25, 2001

(54) EMERGENCY TELEVISION ANTENNA

(76) Inventor: Will Thomas Williams, 3059 Lincoya Bay Dr, Nashville, TN (US) 37214

( * ) Notice: Subject to any disclaimer, the term of this patent is extended or adjusted under 35 U.S.C. 154(b) by 0 days.

(21) Appl. No.: 09/518,219

(22) Filed: Mar. 3, 2000

Related U.S. Application Data

(60) Provisional application No. 60/122,804, filed on Mar. 3, 1999.

(51) Int. Cl.[7] ..... H01Q 1/50
(52) U.S. Cl. ..... 343/906; 439/578
(58) Field of Search ..... 343/702, 830, 343/906; 439/578, 584, 501; H01Q 1/32, 1/50

(56) References Cited

U.S. PATENT DOCUMENTS 5,168,280 * 12/1992 Blaese ..... 343/715
5,448,254 * 9/1995 Schneeman et al. ..... 343/781
5,523,768 * 6/1996 Hemmie et al. ..... 343/840
5,995,053 * 11/1999 Curtis ..... 343/715
6,069,588 * 5/2000 O'Neill ..... 343/713

* cited by examiner

*Primary Examiner*—Tho G Phan
(74) *Attorney, Agent, or Firm*—Penrose Lucas Albright

(57) ABSTRACT

An emergency indoor television antenna is inserted between a cable television wall outlet and a television set that includes a coaxial cable connector. The antenna comprises a spacer containing an electrical conductor that connects to the central conductor of the coaxial cable connector of the television set on one end and to the shielding of the coaxial cable connected to the wall outlet for the television set on the other end. Optionally a switch may be included selectively to connect the electrical conductor to the shielding or to the central conductor of the coaxial cable.

2 Claims, 4 Drawing Sheets

EMERGENCY TELEVISION ANTENNA

This Application claims benefit to provisional Application 60/122,804 Mar. 3, 1999.

FIELD OF THE INVENTION

This invention relates to an antenna for television sets and, more particularly, it relates to an emergency antenna to be used with television sets which are connected by a coaxial cable to a cable television outlet to provide reception from local television stations when signals from the cable television outlet are disrupted.

BACKGROUND OF THE INVENTION

At a variety of locations, primarily apartment buildings, the only operable connection for television sets is to a wall cable television outlet which is provided by the landlord or management of the building. The interconnection thereto is effected by a coaxial cable which extends between the television cable outlet in a wall of the building and the television set. In such cases, in severe adverse weather conditions such as ice storms, signals from the local cable TV company may be disrupted. Unfortunately, at such times, it is particularly important for the people who have such systems to receive information on local weather and road conditions. There are, on the market, a great variety of indoor television antenna such as, for example, those known as "rabbit ears" which can be connected to the television set and, indeed, switching means are available for the operator of the television set to switch from cable television signals, if any are being received, to such an antenna for receiving electromagnetic signals from local TV stations. However, such antenna may not be desired except in times of emergency and the cost of the antenna, per se, or the antenna and the switching means, are more than most people desire to invest to have available for what is essentially an emergency need which seldom occurs. Accordingly, there is a need for an inexpensive and easily installable emergency antenna which can be stored and, when needed, installed without difficulty whereby the owner of the television set will be provided with television broadcasts from local stations with acceptable reception fidelity.

SUMMARY OF THE INVENTION

My invention comprises an emergency antenna which is intended for use with television sets that are connected by coaxial cables to the cable connection from a cable television company. Such coaxial cables comprise a central copper conductor which is retained in a centered position by an insulation material which, in turn, is surrounded by a conductor which may be a steel mesh shield or an aluminum foil shield or the like. I have discovered that by connecting the central signal conductor, which is normally connected to the cable from a local television cable company, with the metal shield of the coaxial cable, the shield effectively functions as an antenna for local television stations; it provides a reception fidelity from local television stations in the area which is as good as, if not better than, antennas known as "rabbit ears."

My invention comprises an insert which can be attached directly to a television set or to a wall connection for the cable TV coaxial cable. Such an insert is relatively small, much less expensive than conventional indoor television antennas and can be conveniently stored for use when needed which is not true of most indoor antennas. By inserting a switch in the connection between the central conductor and the shield, it is possible for the user to switch from cable TV signals to signals from local television stations as desired, whereby the insert can be retained permanently where installed between the cable TV outlet and the television set.

BRIEF DESCRIPTION OF THE DRAWINGS

Other objects, adaptabilities and capabilities will appear as the description progresses, reference being had to the accompanying drawings in which.

DETAILED DESCRIPTION OF THE PREFERRED EMBODIMENTS

Figure 1:
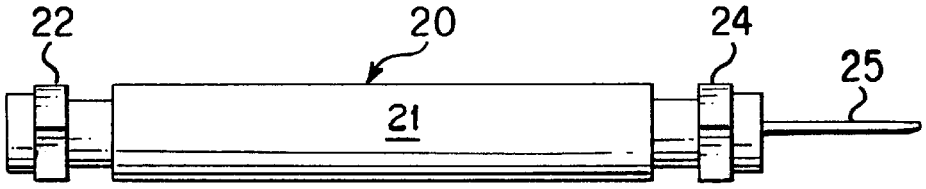
FIG. 1 is a side elevational view of the invention.
Figure 2:
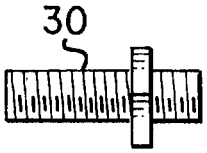
FIG. 2 is a side elevational view of a double nipple fitting for optionally connecting the invention to the wall plate for the cable connection or to the television set.
Figure 3:
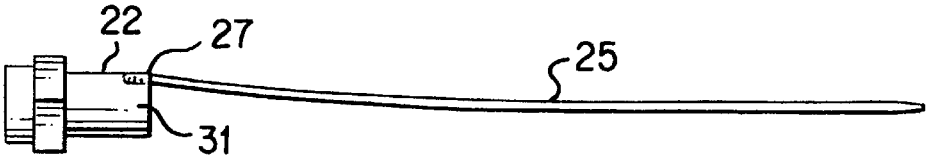
FIG. 3 is a detailed view of a part of the invention comprising a universal "F" type connector fitting which is crimped fastened to a central conductor.
Figure 6:
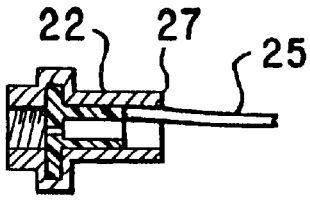
FIG. 6 is a side sectional view of the universal fitting shown in FIG. 3.
Figure 7:
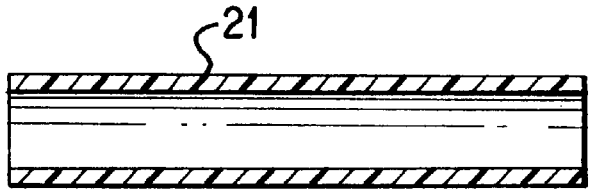
FIG. 7 is a side sectional view of the spacer member shown in FIG. 4.
Figure 8:
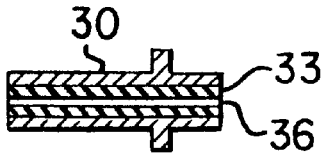
FIG. 8 is a side sectional view of the double nipple fitting shown in FIG. 2.
Figure 9:
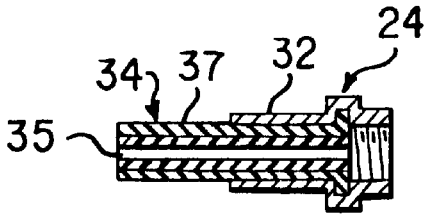
FIG. 9 is a side sectional view of the universal fitting shown in FIG. 5.

A side elevational view of an emergency antenna 20 in accordance with the invention is shown in FIG. 1. Antenna 20 comprises a hollow cylindrical spacer member 21 which is composed of a high dielectric insulating material and is tubular in cross-section as seen in FIG. 7. One end of spacer 21 has, tightly fitted thereto, a universal "F" connection (type RG6) fitting 22. At the other end, also received in a tight frictional fitting, is a further similar universal fitting 24. A copper wire conductor 25 is connected by crimping which is sufficient to provide a good electrical connection to universal fitting 22 as shown in FIGS. 3 and 6 at connection 27. This and other connections can, of course, be effected by soldering. However, in practice, crimping at connection 27 of fitting 22 has proved satisfactory and not only reduces the cost of manufacture of antenna 20, but also eliminates the possibility that intervening insulation may be softened whereby conductor 25, which is intended at this juncture to be electrically connected to shielding of the coaxial cable is not inadvertently also electrically connected via softened insulation to some extent to the central connector which extends from the wall connection.

Double nipple 30 which contains an insulation core 33 having a bore 36 therethrough is threaded so that it can be threadably received by universal fittings 22 and 24.

Figure 4:
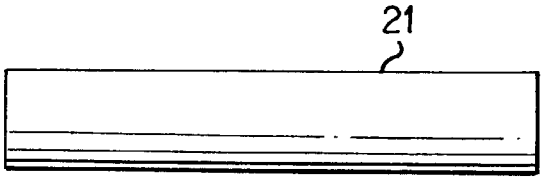
FIG. 4 is a side elevational view of a tubular insulation part which interconnects the opposing universal fittings.
Figure 5:
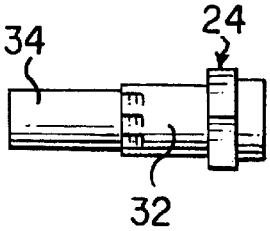
FIG. 5 is a side elevational view of the universal "F" type connector fitting which connects directly or indirectly to the television set.

FIGS. 3, 4 and 5 show the individual components of the parts which make up antenna 20 shown in FIG. 1. Thus, fitting 22 at a connection 27 thereto engages conductor 25 so as to facilitate electrical current flow of signals between fitting 22 and conductor 25, fitting 22 being electrically connected either directly, or through a further coaxial cable to the wall input connection from the cable TV. The shank 32 of fitting 24 is tightly received in the cylindrical spacer 21 with conductor 25 extending through the tubular opening of spacer 21. Shank 32 of fitting 24 receives an insulation projection 34 covered by a rubber sleeve 37 which is firmly received at the opposite end of spacer 21 together with shank 32. Projection 34 has a central bore 35 through which conductor 25 extends.

Figure 10:
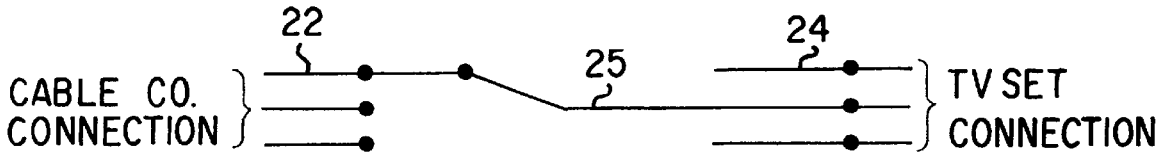
FIG. 10 is an electrical diagram showing how the central conductor from the television set is connected to the shield member of the cable television connection.

As seen in FIG. 10, conductor 25 effects an electrical connection between the central conductor 25 from the television set connection on one hand, and the electrical shielding of the cable company terminal on the other hand.

Figure 11:
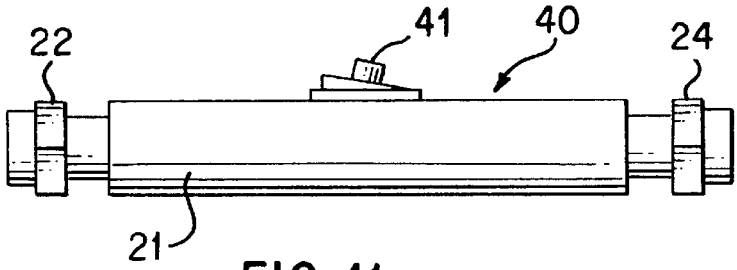
FIG. 11 is similar to FIG. 1 showing an embodiment which includes a switch whereby the central conductor connected to the television set can be selectively connected to the shielding of the coaxial cable or to its central conductor.
Figure 12:
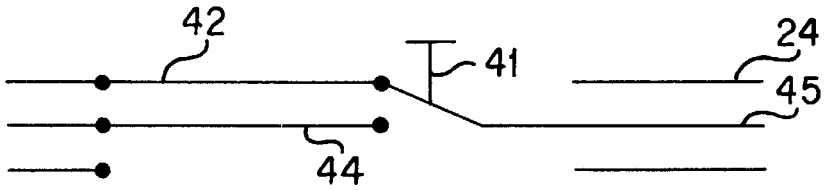
FIG. 12 is an electrical diagram showing how the central conductor of FIG. 11 selectively connects the central conductor from the television set either to the coaxial shield or to its central conductor leading to the cable television wall outlet.

FIG. 11 is a side elevational view of an alternative embodiment antenna 40 which includes a switch 41 that alternatively provides means for switching the internal conductor 45 between the shielding 42 and the coaxial cable internal conductor 44 which, in this embodiment, extends from the fitting 22. Also, in this embodiment, spacer 21 preferably includes an external conductive shield. The advantage of the embodiment shown in FIGS. 11 and 12 is that the invention can be permanently installed in series with the coaxial cable between the cable TV wall outlet and the television set input connection whereupon reception by the television set, either to local stations or to the television cable, can be controlled by switch 41.

Figure 13:
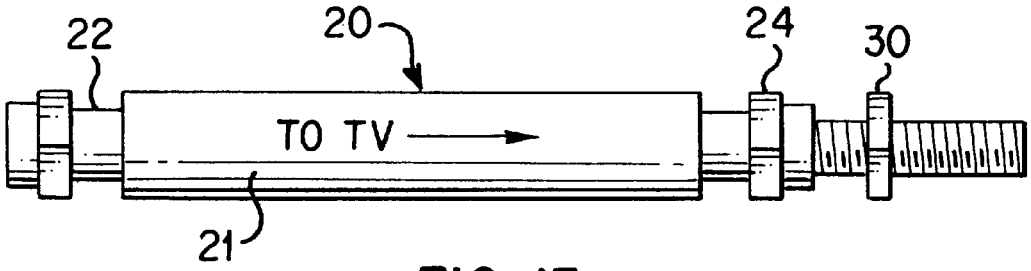
FIG. 13 illustrates the connection of the components shown in FIGS. 1 and 2 when the invention is connected directly to a television cable wall connector on one end to the coaxial cable from the television set on the other.
Figure 14:
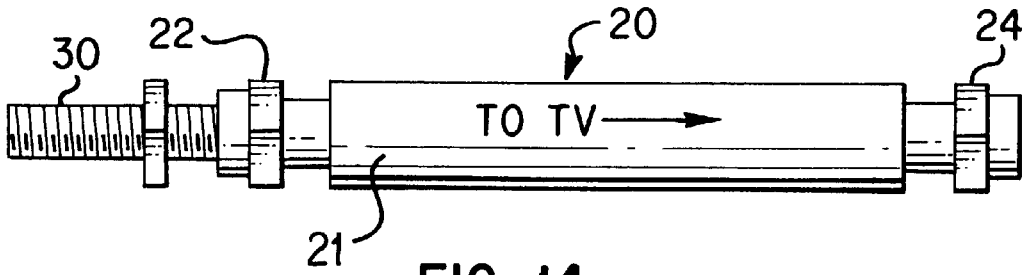
FIG. 14 illustrates how the components of FIGS. 1 and 2 are connected when the invention is connected directly to a television set on one side and a coaxial cable connected to a wall connection on the other.

FIGS. 13 and 14 illustrate the two ways that double nipple 30 can be connected to antenna 20. FIG. 13 shows the arrangement when antenna 20 is directly connected to the coaxial cable wall connection. Thus, after disconnecting the coaxial cable from the wall, fitting 24 is firmly connected to the wall connection with the double nipple 30 being connected to fitting 24 on the right hand side. To this, the coaxial cable which was connected to the wall connector is now connected. In other words, with fitting 22 connected to the wall cable connection, the antenna 20, adaptor nipple 30 and the just disconnected coaxial cable will be arranged in series.

FIG. 14 shows the arrangement with double nipple 30 on the left when antenna 20 is connected directly to the television connection via fitting 24. In this case, double nipple 30 is connected to fitting 22 and the coaxial cable fitting which would otherwise be received by the television set is now received by the threaded end of adaptor nipple 30. Thus in this arrangement, commencing at the wall connection for cable TV, the coaxial cable will remain connected to that outlet, but on its other end, be connected in series to the adaptor nipple 30 and antenna 20 which connects via fitting 24 with the television connection which would otherwise be for the coaxial cable from cable television.

It will be noted that in FIGS. 13 and 14, the legend "To TV" together with an arrow is shown on the side of the spacer 21. This is important because it would otherwise be possible to connect the fittings 22 and 24 in a reverse sequence whereby the invention would be inoperable.

Spacer 21 is preferably about two inches in length. Because spacer 21 is generally a rigid tube composed of insulating material, its relatively short length permits its installation between the rear side of most television sets where they connect to coaxial cables and therefrom to an adjacent wall. Larger spacers can be used. But in such case, preferably they should be composed of a flexible material which is bendable so that the invention can be connected with the conventional coaxial cable without causing the television set to be spaced unduly far from the wall adjacent to its rear. By means of the invention, the shielding for the coaxial cable is, for the purpose of the invention, being used as an antenna together with conductor 25 which passes through the spacer 21. Although the invention obviously is not a sophisticated outdoor type of antenna, it works surprisingly well and, as previously indicated, comparable to or better than most commercially available indoor television antennas. It thus has utility not only for emergency purposes, but also in situations wherein the occupant of the building having a coaxial cable outlet from a cable television company does not desire to take advantage of the cable television.

Although I have disclosed the preferred embodiments of my invention, it is to be understood that it is capable of other adaptations and modifications within the scope of the appended claims:

Having thus disclosed my invention, what I claim is new and desire to be secured by Letters Patent of the United States is:

1. An indoor television antenna which is inserted in series between a cable television wall outlet and a television set that includes a coaxial cable connector, the antenna comprising a spacer Which contains an electrical conductor that connects to a central conductor of said coaxial cable connector of said television set on one end and to shielding of a coaxial cable connected to said wall outlet for the television set on the other end.

2. An indoor antenna in accordance with claim 1, wherein said conductor in said spacer is provided with switch means for switching a connection between said coaxial cable shielding and the central conductor of said coaxial cable connector.

* * * * *